US005144300A

United States Patent [19]

Kanno

[11] Patent Number: 5,144,300

[45] Date of Patent: * Sep. 1, 1992

[54] STARTING EVICE FOR MARINE PROPULSION ENGINE

[75] Inventor: Isao Kanno, Hamamatsu, Japan

[73] Assignee: Sanshin Kogyo Kabushiki Kaisha, Hamamatsu, Japan

[ * ] Notice: The portion of the term of this patent subsequent to Feb. 6, 2007 has been disclaimed.

[21] Appl. No.: 502,533

[22] Filed: Mar. 30, 1990

[30] Foreign Application Priority Data

Mar. 30, 1989 [JP] Japan ..... 1-78904

[51] Int. Cl.[5] ..... G08B 23/00

[52] U.S. Cl. ..... 340/984; 123/198 DC; 307/10.6; 440/85

[58] Field of Search ..... 340/984; 440/1, 2, 84, 440/85; 123/198 DC, 179 B, 179 BG; 307/10.3, 10.6

[56] References Cited

U.S. PATENT DOCUMENTS

| | | | |
|---|---|---|---|
| 4,648,364 | 3/1987 | Wills | 123/198 DC |
| 4,871,996 | 10/1989 | Tsunamoto et al. | 440/2 |
| 4,898,132 | 2/1990 | Kanno | 123/198 DC |
| 4,949,684 | 8/1990 | Gohara | 123/198 DC |

*Primary Examiner*—Jin F. Ng
*Assistant Examiner*—Brent A. Swarthout
*Attorney, Agent, or Firm*—Ernest A. Beutler

[57] ABSTRACT

An improved warning system for a marine propulsion unit that includes a starter, a starter switch, an ignition circuit having a kill switch for disabling the ignition circuit, a warning device and an abnormal operating condition sensor. The warning device is in circuit with the abnormal engine condition sensor and the device for sensing an attempt to start the engine with the kill switch enabled so that the single warning device will indicate either of the conditions.

2 Claims, 2 Drawing Sheets

STARTING EVICE FOR MARINE PROPULSION ENGINE

BACKGROUND OF THIS INVENTION

This invention relates to a starting device for a marine propulsion engine and more particularly to a warning system for an engine having a starting circuit, a kill circuit and means for detecting an abnormal running condition.

In many forms of engines, there is provided a kill arrangement for emergency stopping of the engine which kill circuit disables the engine ignition circuit so as to stop the engine. Of course, if attempts are made to start the engine when the kill circuit is enabled, starting will not be possible and various problems can be encountered. That is, the battery can be depleted and the engine can become flooded when repeated starting attempts are made when the ignition system is disabled. In order to prevent this condition, it has been proposed to provide a warning arrangement wherein either a visual or audible warning is provided to the operator in the event he attempts to start the engine when the kill switch is enabled. Although these devices have great utility, it may also be desirable to equip the engine with other warning devices that can warn of abnormal conditions that may exist during running of the engine, such as overheating, low oil level or the like. The addition of plural warning systems to the engine and the associated warning devices can add significantly to the cost. The type of kill switch warning previously mentioned has not lent itself to the use of the same warning device for these other abnormal conditions due to the circuitry involved.

It is, therefore a principal object of this invention to provide an improved and simplified warning system for the starting of a marine propulsion device wherein the warning device can also provide other warning indications.

It is a further object of this invention to provide an improved and simplified warning arrangement for an internal combustion engine.

SUMMARY OF THE INVENTION

This invention is adapted to be embodied in a warning system for an internal combustion engine having a starter for starting the engine and a starter switch that actuates the starter to start the engine. The engine is also provided with an ignition system for firing the spark plug of the engine and a kill switch for disabling the ignition system to stop the running of the engine. A warning device is provided for providing a warning signal to the operator. In accordance with the invention, the warning device is actuated either in the event of the sensing of an abnormal running condition of the engine or in the event of an attempt to start the engine when the kill switch is enabled.

DETAILED DESCRIPTION OF THE PREFERRED EMBODIMENTS OF THE INVENTION

Figure 1:
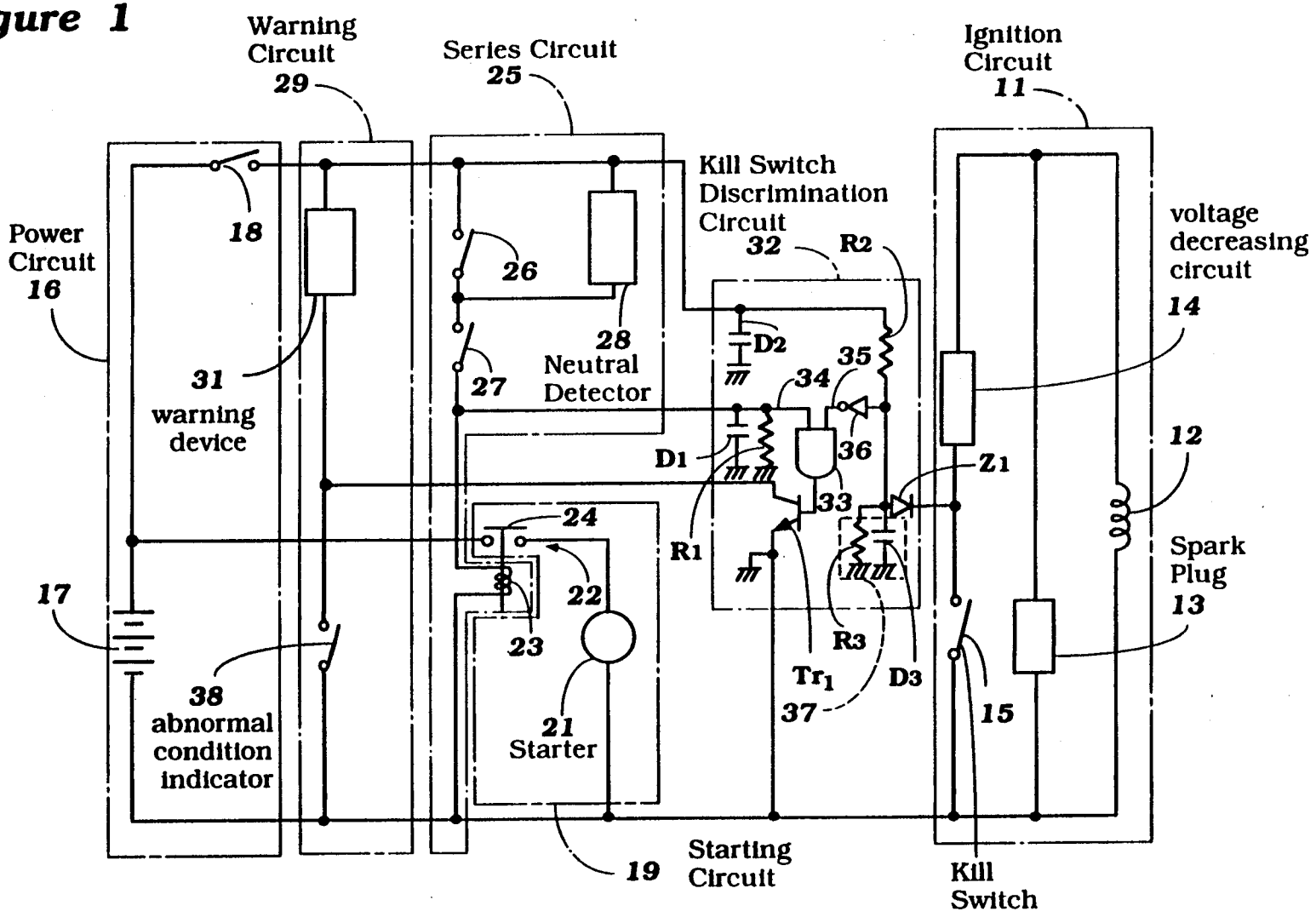
FIG. 1 is a schematic electrical diagram of an engine warning system and other associated engine systems constructed in accordance with a first embodiment of the invention.

Referring first to FIG. 1, this depicts a schematic electrical circuit for portions of a marine propulsion unit utilizing an embodiment of the invention. Many of the components have been shown only schematically because the specific details of individual circuits per se can be conventional. For example, the circuitry includes an ignition system for an internal combustion engine which is shown by the block 11 and which may be of the capacitor discharge type that includes a magneto generator having a charging coil 12 which is in circuit with a spark plug 13 for firing that spark plug. This circuit further includes a voltage decreasing circuit 14 in which a kill switch 15 is interposed for disabling the ignition circuit 11 and stopping the engine. As noted, the full details of the ignition circuit 11 are not illustrated since any of the conventional types of ignition systems can be employed so long as they include a kill switch 15 for disabling the ignition circuit and stopping the engine.

The watercraft is also provided with a main power circuit, indicated by the box 16 and which includes a battery 17 that is charged by a generating coil of the engine through a regulator (not shown). A main switch 18 interconnects the battery with a variety of circuits as will be described including a starting circuit, indicated generally by the reference numeral 19. The starting circuit 19 includes a starter motor 21 that is energized by means of a starting relay 22 having a winding 23 and a contact 24. The winding 23 is in circuit with a series circuit 25 that includes a starter switch 26 and a neutral detecting switch 27. The neutral detecting switch 27 is associated with the transmission (not shown) of the watercraft and is normally opened except when the transmission is in neutral. This insures that the engine cannot be started until the transmission is shifted into neutral. A neutral detecting circuit 28 also is incorporated in the series circuit 25 for providing a signal when the transmission is in neutral. If the transmission is in neutral and the neutral detecting switch 27 is closed, operation of the starter switch 26 will energize the winding 23 of the starter solenoid 22 and close the contact 24 so as to energize the starting motor 21 and start the engine.

There is further provided a warning circuit, shown by the block 29 and which includes a warning device 31 that provides either or both of an audio or visual warning to the operator of the watercraft in the event of an abnormal condition or in the event an attempt is made to start the engine when the kill switch 15 is enabled. This latter operation is sensed by a kill switch discriminating circuit indicated by the block 32.

The kill switch discriminating circuit 32 includes a conductor wired between the neutral discriminating switch 27 and the starter solenoid winding 23 and the ground and which includes an AND circuit 33 that controls an SCR Trl. When the AND circuit 33 is enabled, the transistor Trl will be switched on and the warning device 31 sounded. The AND circuit 33 has a first input terminal 34 that is in the aforenoted circuit and which has associated with it a capacitor D1 and resistor R1.

Another terminal 35 of the AND circuit 33 receives an input from the battery through a resistor R2 and diode 36. A filter 37 comprised of a resistor R3 and capacitor D3 is in this circuit. A diode Z1 connects this circuit to the kill switch 15.

The capacitor D1 and resistor R1 provide a stable voltage to the AND circuit terminal 34. The input to the terminal 35 is stabilized by the capacitor D2 and resistor R2 to absorb voltage fluctuations during switching. As a result, this system is relatively noise free.

When the kill switch 15 is opened, the output of the invertor 36 has a low voltage level and the input to the terminal 35 of the AND circuit 33 is low. Thus, if the starter switch 26 is closed and the neutral switch 27 is also closed, the starting relay 22 will be energized and the starter motor 21 can be operated. At this time, the input to the terminal 34 of the AND circuit will be high but the input to the terminal 35 will be low. Hence the transistor Trl is not switched. The warning device 31 will therefore not be actuated and the motor can be started without any warning.

If, however, the kill switch 15 is closed, then the output voltage of the invertor 36 becomes high and the AND circuit 33 will actuate and bias the transistor Trl so as to turn it on and actuate the warning device 31. The warning device 31 also has wired in parallel circuit to the transistor Trl an abnormal condition indicator 38 which may be actuated by any of a variety of abnormal conditions such as high engine temperature, low lubricant level, over-speed or a wide variety of other such conditions. When the abnormal condition indicator 38 is switched on, the warning device 31 will also be actuated. Hence a single warning device can be utilized so as to provide both this type of warning and also a warning in the event of attempt to start the engine with the kill switch enabled.

Figure 2:
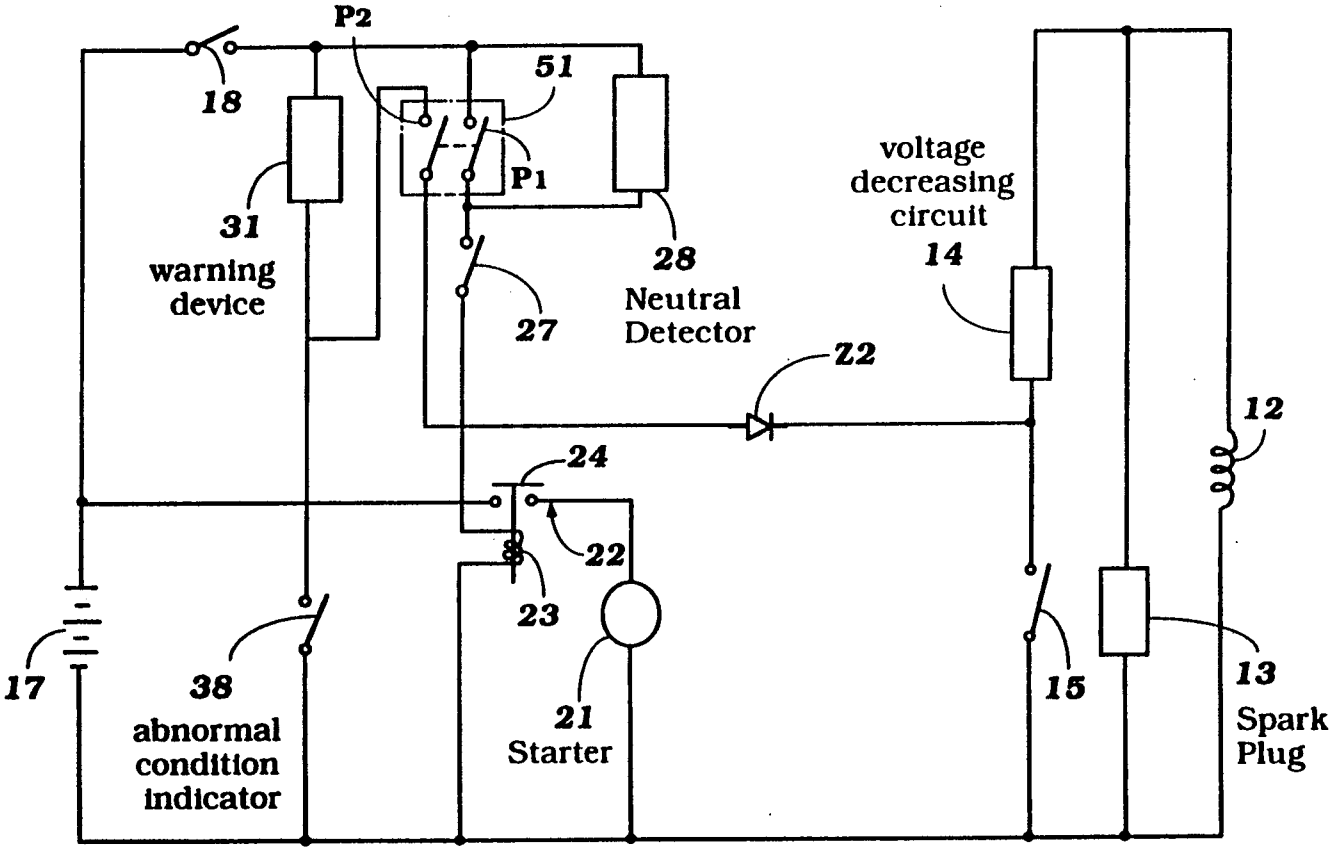
FIG. 2 is a circuit diagram of another embodiment of the invention.

Another and somewhat simpler circuit for accomplishing the invention is illustrated in FIG. 2 and this circuit embodies some of the same components of the previously described circuit. For that reason, those components have been identified by the same reference numerals and will not be described again, except insofar as may be necessary to understand the construction and operation of this embodiment.

In this embodiment, it should be noted that a starter switch 51 is provided that has a pair of contacts P1 and P2. The contact P1 is in circuit with the neutral switch 27 and when closed operates the starter solenoid 22 so as to energize the starter as previously described. In addition, the terminal P2 is in circuit with the warning device 31 and the ignition circuit between the voltage reducing device 14 and the kill switch 15 with a diode Z2 being interposed in this circuit. Hence, if the starter switch 51 is energized and the kill switch 15 is closed, the circuit will be completed through the warning device 31 and it will be energized. However, if the kill switch 15 is opened, then no warning will be given.

It should be readily apparent from the foregoing description that the embodiments of the invention are particularly useful in providing a warning of the attempt to start the engine with the kill switch enabled and also a warning through the same warning device of other abnormal engine or operating conditions. As a result, a very simple and highly effective warning arrangement is provided. Although two embodiments of the invention have been illustrated and described, various changes and modifications may be made without departing from the spirit and scope of the invention, as defined by the appended claims.

I claim:

1. A warning system for a spark ignition internal combustion engine having a starter for starting said engine, a starter switch for actuating said starter to start said engine, an ignition system for firing a spark plug of said engine, a kill switch for disabling said ignition system to stop the running of said engine, means for sensing when said starter switch is operated and said kill switch is enabled, a warning device for providing a warning signal, an abnormal when running and when said running condition is abnormal and means for effecting operation of said warning device in response to each of the sensing of an abnormal condition by said abnormal running condition sensor and the attempt to start the engine with the kill switch enabled by closure of the starter switch.

2. A warning system as set forth in claim 1 wherein a means for sensing the attempt to start the engine with the kill switch enabled and the abnormal condition sensor are in circuits with the warning device so that either can effect operation of the warning device without operation of the other.

* * * * *

UNITED STATES PATENT AND TRADEMARK OFFICE

CERTIFICATE OF CORRECTION

PATENT NO. : 5,144,300

DATED : September 1, 1992

INVENTOR(S) : Isao Kanno

It is certified that error appears in the above-identified patent and that said Letters Patent is hereby corrected as shown below:

On the Title Page, in the Title, "EVICE" should be --DEVICE--.

Column 1, line 2, in the Title, "EVCIE" should be --DEVICE--.

Column 4, line 32, Claim 1, after "abnormal" insert --running condition sensor, for sensing a condition of the engine--.

Signed and Sealed this

Twenty-eighth Day of September, 1993

Bruce Lehman

*Attest:*

BRUCE LEHMAN

*Attesting Officer*

*Commissioner of Patents and Trademarks*